US011083217B2

(12) United States Patent
Bachmann et al.

(10) Patent No.: US 11,083,217 B2
(45) Date of Patent: Aug. 10, 2021

(54) FILTER PAPER FOR CIGARETTE FILTERS

(71) Applicant: DELFORTGROUP AG, Traun (AT)

(72) Inventors: Stefan Bachmann, Fulpmes (AT); Christian Mair, Fritzens (AT); Dietmar Volgger, Gnadenwald (AT)

(73) Assignee: delfortgroup AG, Traun (AT)

( * ) Notice: Subject to any disclaimer, the term of this patent is extended or adjusted under 35 U.S.C. 154(b) by 128 days.

(21) Appl. No.: 16/087,172

(22) PCT Filed: Jan. 24, 2017

(86) PCT No.: PCT/EP2017/051368
§ 371 (c)(1),
(2) Date: Sep. 21, 2018

(87) PCT Pub. No.: WO2017/162347
PCT Pub. Date: Sep. 28, 2017

(65) Prior Publication Data

US 2019/0059443 A1 Feb. 28, 2019

(30) Foreign Application Priority Data

Mar. 21, 2016 (DE) ..... 102016105235.3

(51) Int. Cl.

| | |
|---|---|
| ***A24D 3/10*** | (2006.01) |
| ***D21H 11/00*** | (2006.01) |
| ***D21H 15/06*** | (2006.01) |
| ***D21H 27/08*** | (2006.01) |
| ***A24D 3/06*** | (2006.01) |
| ***D21H 27/00*** | (2006.01) |

(52) U.S. Cl.
CPC ..... *A24D 3/10* (2013.01); *A24D 3/06* (2013.01); *D21H 11/00* (2013.01); *D21H 15/06* (2013.01); *D21H 27/00* (2013.01); *D21H 27/08* (2013.01)

(58) Field of Classification Search
None
See application file for complete search history.

(56) References Cited

U.S. PATENT DOCUMENTS 5,394,895 A * 3/1995 Muramatsu ..... A24D 1/027 131/336
6,103,294 A * 8/2000 Bendiner ..... D21C 5/02 426/654
6,568,402 B1 5/2003 Kaneki et al.
2013/0014774 A1* 1/2013 Sebastian ..... B05D 1/28 131/332
2015/0173414 A1 6/2015 Bachmann et al.
2015/0374030 A1* 12/2015 Lisauskas ..... A24D 3/068 131/345

FOREIGN PATENT DOCUMENTS

WO WO 2014/015921 A1 * 1/2014

OTHER PUBLICATIONS

The CORESTA Unit, Cooperation Centre for Scientific Research Relative to Tobacco, no date, [online],retrieved from the Internet,[retrieved Aug. 20, 2020], <URL: https://www.coresta.org/coresta-unit-cu>. (Year: 2020).*
H. Holik (Ed.), *Handbook of Paper and Board*, Second Edition, Wiley-VCH, Dec. 4, 2013. Abschn. 2.3.4, S. 54.—ISBN 978-3-527-33184-0, pp. 33-108.
Sable et al., "Properties of wood and pulp fibers from lodgepole pine (*Pinus contorta*) as compared to scots pine (*Pinus sylvestris*)." *BioResources* 7, No. 2 (2012): 1771-1783.
International Searching Authority—EPO, International Search Report and Written Opinion, PCT/EP2017/051368. 10 pages, dated 2017.
International Searching Authority—EPO, International Preliminary Report on Patentability, dated 2017 (English Translation), PCT/EP2017/051368. 7 pages.
China National Intellectual Property Administration, First Office Action, Application No. 201780018157.9, dated Sep. 24, 2020 *with English translation*, 21 pages.
Proceedings of the 7th Annual Conference of China Technical Association of Paper Industry, China Technical Association of Paper Industry, pp. 293-295, Jan. 1994 (*with English translation*) 14 pages.

* cited by examiner

*Primary Examiner* — Dennis R Cordray
(74) *Attorney, Agent, or Firm* — Sunstein LLP

(57) ABSTRACT

Disclosed herewith is a filter paper for manufacturing filters for smoking articles, in particular filter cigarettes, with the following properties the filter paper comprises fibers comprising pulp fibers, at least 80% by weight, preferably at least 90% by weight, particularly preferably at least 95% by weight and highly particularly preferably 100% by weight of the filter paper is formed by long-fiber pulp fibers, of the fibers, a proportion with respect to the number of the fibers of between 2% and 10%, preferably between 3% and 9% and particularly preferably between 4% and 8% has a length of less than 0.2 mm, the air permeability of the filter paper, measured in accordance with ISO 2965:2009, is between 500 $cm \cdot min^{-1} \cdot kPa^{-1}$ and 15000 $cm \cdot min^{-1} \cdot kPa^{-1}$ and preferably between 1000 $cm \cdot min^{-1} \cdot kPa^{-1}$ and 9000 $cm \cdot min^{-1} \cdot kPa^{-1}$, the number-averaged length of the fibers in the filter paper is greater than 1 mm and less than 5 mm, preferably greater than 2 mm and less than 4 mm, and the number-averaged width of the fibers in the filter paper is between 10 μm and 50 μm, preferably between 20 μm and 40 μm, and particularly preferably between 25 μm and 35 μm.

37 Claims, 4 Drawing Sheets

| No. | Settings of the Papillon Refiner | | Fiber Properties | | |
|---|---|---|---|---|---|
| | Revolutions | Power | Mean Length | Mean Width | Fine Fiber Content |
| | $min^{-1}$ | kW | mm | µm | % |
| 1 | 601 | 101.0 | 2.06 | 31.20 | 5.20 |
| 2 | 1050 | 60.5 | 2.34 | 31.03 | 8.00 |
| 3 | 1200 | 60.5 | 2.41 | 31.10 | 6.67 |
| 4 | 600 | 101.1 | 2.42 | 30.97 | 5.73 |
| 5 | 900 | 59.8 | 2.45 | 31.07 | 5.80 |
| 6 | 699 | 119.1 | 2.47 | 30.83 | 5.63 |
| 7 | 699 | 119.1 | 2.43 | 30.9 | 5.83 |
| 8 | 801 | 135.5 | 2.42 | 30.87 | 5.80 |
| 9 | 900 | 141.5 | 2.42 | 30.87 | 6.10 |
| 10 | 900 | 98.8 | 2.48 | 30.87 | 5.97 |
| 11 | 900 | 142.5 | 2.42 | 30.97 | 6.03 |
| 12 | 600 | 59.4 | 2.43 | 31.03 | 6.07 |
| 13 | 1200 | 101.5 | 2.46 | 31.13 | 5.60 |
| 14 | 1200 | 139.6 | 2.44 | 30.70 | 6.20 |
| 15 | 1200 | 63.0 | 2.41 | 31.07 | 6.03 |
| 16 | 1200 | 100.3 | 2.45 | 31.13 | 6.40 |

Fig. 1

| No. | Basis Weight | Thickness | Air Permeability | Tensile Strength | | Elongation | |
|---|---|---|---|---|---|---|---|
| | | | | MD | CD | MD | CD |
| | $g \cdot m^{-2}$ | μm | $cm \cdot min^{-1} \cdot kPa^{-1}$ | N/15 mm | N/15 mm | % | % |
| 1 | 35.6 | 86 | 1925 | 33.2 | 5.91 | 1.6 | 5.1 |
| 2 | 36.2 | 101 | 8364 | 8.3 | 4.48 | 1.3 | 4.3 |
| 3 | 36.3 | 100 | 8080 | 8.8 | 4.70 | 1.2 | 3.9 |
| 4 | 35.3 | 85 | 2665 | 30.7 | 5.92 | 1.8 | 5.5 |
| 5 | 35.7 | 93 | 5823 | 14.1 | 6.46 | 1.5 | 3.9 |
| 6 | 34.9 | 87 | 3588 | 23.9 | 6.46 | 1.6 | 5.2 |
| 7 | 35.8 | 85 | 1440 | 40.1 | 5.75 | 1.7 | 4.6 |
| 8 | 35.1 | 83 | 1444 | 40.0 | 5.39 | 1.7 | 4.6 |
| 9 | 35.7 | 88 | 1099 | 44.1 | 5.47 | 1.8 | 5.3 |
| 10 | 36.6 | 86 | 2112 | 31.3 | 6.10 | 1.8 | 4.8 |
| 11 | 35.9 | 89 | 1191 | 41.3 | 5.19 | 1.7 | 5.2 |
| 12 | 36.5 | 88 | 3373 | 24.1 | 7.12 | 1.6 | 4.1 |
| 13 | 35.6 | 91 | 4931 | 16.8 | 6.92 | 1.5 | 4.3 |
| 14 | 36.3 | 88 | 3419 | 25.3 | 5.86 | 1.6 | 4.9 |
| 15 | 36.2 | 97 | 7771 | 9.1 | 4.69 | 1.3 | 4.2 |
| 16 | 36.5 | 96 | 6327 | 13.8 | 5.47 | 1.5 | 3.9 |

Fig. 2

| No. | Filtration Efficiency (22 mm) | Draw Resistance (22 mm) | Specific Draw Resistance |
|---|---|---|---|
| | % | Pa | $Pa \cdot mm^{-1}$ |
| 1 | 36.5 | 324.7 | 14.8 |
| 2 | 51.8 | 676.2 | 30.7 |
| 3 | 53.0 | 683.7 | 31.1 |
| 4 | 41.1 | 370.4 | 16.8 |
| 5 | 51.6 | 547.4 | 24.9 |
| 6 | 44.5 | 401.9 | 18.3 |
| 7 | 37.3 | 298.4 | 13.6 |
| 8 | 39.6 | 279.3 | 12.7 |
| 9 | 36.2 | 273.3 | 12.4 |
| 10 | 44.1 | 368.9 | 16.8 |
| 11 | 39.4 | 288.2 | 13.1 |
| 12 | 50.6 | 427.9 | 19.5 |
| 13 | 48.4 | 486.1 | 22.1 |
| 14 | 47.2 | 450.5 | 20.5 |
| 15 | 55.2 | 611.4 | 27.8 |
| 16 | 54.8 | 553.1 | 25.1 |

Fig. 3

FILTER PAPER FOR CIGARETTE FILTERS

CROSS-REFERENCE TO RELATED APPLICATIONS

This Application is a U.S. national stage entry under 35 USC § 371 of Patent Cooperation Treaty Application PCT/EP2017/051368, filed Jan. 24, 2017, which claims priority from German Patent Application 10 2016 105 253.3, filed Mar. 21, 2016, both of which are incorporated herein by reference in their entireties.

FIELD OF THE INVENTION

The present invention relates to a paper for the manufacture of a cigarette filter and a process for the production of the filter paper. The invention further relates to an associated cigarette. A filter manufactured from the filter paper according to the invention has retention properties which are similar to those of cellulose acetate filters and thus improves the taste of a cigarette manufactured from this filter paper compared with cigarettes with paper filters from conventional filter papers.

BACKGROUND AND RELATED PRIOR ART

A conventionally manufactured filter cigarette in general consists of a cylindrical column of tobacco, which is wrapped with a cigarette paper, and a filter, which consists of a filter material and is wrapped with a filter wrapping paper. A common filter material is cellulose acetate. Typically, the tobacco column and the filter are connected to each other by a tipping paper.

As an alternative to cellulose acetate fibers, paper is a known filter material for cigarettes. A cigarette filter can consist of several segments, wherein each segment can be formed from a different material. For example, filters consisting of two segments are known in the prior art, wherein one segment is a cellulose acetate filter and a second segment is a paper filter. It is also known to mix cellulose acetate fibers and pulp fibers in one segment or to separately arrange structures formed from these fibers within a segment, for example in the longitudinal or in the radial direction.

Generally, paper filters have the advantage that they degrade faster in the environment and that they are in general cheaper than cellulose acetate filters. An essential disadvantage of a conventional paper filter, however, is that it has different retention properties compared with a filter made from cellulose acetate. It is, for example, known that at comparable draw resistances, the filtration efficiency of a paper filter for tar is higher than that of a cellulose acetate filter. Paper filters also tend to retain water and water vapor much better than cellulose acetate filters. Both these effects can, among other things, change the taste of a cigarette in an undesirable manner. Furthermore, the draw resistance at a given filtration efficiency, that is the resistance that the filter provides against the flowing smoke, is substantially lower than for a filter produced from cellulose acetate. Similarly, the hardness of a paper filter, that is the resistance against mechanical deformation, often does not meet the smoker's expectations, who is used to a cellulose acetate filter.

EP 2 761 085 describes a particularly good biodegradable paper for paper filters, but it cannot solve the problems with respect to the taste or the filtration efficiency in a fully satisfactory manner.

It is known that certain substances can be added to the paper filter to control the filtration efficiency or improve the taste, such as triacetin, propylene glycol, sorbitol, glycerin, polyethylene glycol or triethyl citrate. The addition of such substances, however, does not solve the existing problems with respect to the draw resistance and the hardness, and it increases the price of the paper filter.

Thus, there is a need to have a filter paper available that provides a filter manufactured therefrom with properties which are more similar to those of a filter from cellulose acetate than to paper filters for cigarettes manufactured from conventional filter papers.

SUMMARY OF THE INVENTION

The objective of the present invention is to provide a filter paper which can be produced in a simple and cost-efficient way and at the same time provides a filter manufactured therefrom with a filtration efficiency which, at comparable draw resistances, is similar to a filter from cellulose acetate. This objective is achieved by a filter paper according to claim 1 and its production process according to claim 15. Further objects of the invention are a filter and a filter cigarette that use this material. Advantageous embodiments are provided in the dependent claims.

According to the invention, a paper is proposed for use as a filter paper, which has the following properties:

- the filter paper comprises fibers,
- at least 80% by weight, preferably at least 90% by weight and particularly preferably at least 95% by weight and highly particularly preferably 100% by weight of the filter paper are formed by long-fiber pulp fibers,
- the proportion of fibers with a length of less than 0.2 mm with respect to the number of fibers is between 2% and 10%, preferably between 3% and 9% and particularly preferably between 4% and 8%,
- the air permeability of the filter paper, measured in accordance with ISO 2965:2009, is between 500 $cm \cdot min^{-1} \cdot kPa^{-1}$ and 15000 $cm \cdot min^{-1} \cdot kPa^{-1}$, and preferably between 1000 $cm \cdot min^{-1} \cdot kPa^{-1}$ and 9000 $cm \cdot min^{-1} \cdot kPa^{-1}$,
- the number-averaged length of the fibers in the filter paper is greater than 1 mm and less than 5 mm, preferably greater than 2 mm and less than 4 mm, and
- the number-averaged width of the fibers in the filter paper is between 10 μm and 50 μm, preferably between 20 μm and 40 μm, and particularly preferably between 25 μm and 35 μm.

The inventors have found that the amount of fine fibers in the filter paper, that is fibers with a length of less than 0.2 mm, is an important factor in reducing the filtration efficiency of a filter manufactured from the filter paper according to the invention and make it more similar to that of a cellulose acetate filter. This is surprising, as the fine fibers as such have a large surface and their presence should thus increase the filtration efficiency. In fact, too many as well as too few fine fibers in the filter paper is not beneficial, but rather, their proportion with respect to the number of fibers in the filter paper should be in the narrow range of between 2% and 10%.

Furthermore, the inventors have found that the air permeability of the filter paper is an essential parameter in controlling the draw resistance of the paper filter and thus its filtration efficiency over a wide range. This is surprising, because the smoke from a cigarette typically flows in the paper filter along the surface of the filter paper and not through the filter paper. Contrary to the expectations of a skilled person, there is a close relationship between air permeability, draw resistance and filtration efficiency. The air permeability should in this case be between 500 $cm \cdot min^{-1} \cdot kPa^{-1}$ and 15000 $cm \cdot min^{-1} \cdot kPa^{-1}$.

The air permeability is influenced by the intensity of refining of the fibers. In this respect, intensely refined fibers lead to a low air permeability and less intensely refined fibers lead to a high permeability. However, since, apart from air permeability, the content of fine fibers is also influenced by refining of the fibers, it is not self-evident that at an approximately constant content of fine fibers the air permeability can be adjusted at all within the range according to the invention. Additionally, the filter paper has to comply with requirements regarding the mechanical strength, which is also substantially influenced by refining of the fibers.

The simultaneous combination of all these requirements is further achieved by the process according to the invention described below, in which at least a part of the fiber material is refined in a special refiner with specific settings.

The fiber dimensions in the filter paper influence its surface and thus also its air permeability and the filtration efficiency of a filter manufactured therefrom. Thus, it is advantageous for the mean length and width of the fibers in the filter paper to be within a certain range.

The length of the fibers in the filter paper and their width can be measured in accordance with ISO 16065 according to the automated optical method described therein. In contrast to ISO 16065, however, the fiber fractions with a length of less than 0.2 mm are considered in the measurement. Such a measurement is possible with the L&W Fiber Tester Plus—code 912 Plus instrument from Lorentzen & Wettre, which also allows the amount of fine fibers to be determined. In this regard, a sample of about 0.1 g of dry fibers is suspended in water and pumped by the instrument through a narrow gap between two plates. At the same time, a camera monitors the fiber suspension flowing in the narrow gap between the plates and records images in quick succession, which are analyzed to determine the geometry of the flowing fibers. The result provided by this instrument is, among others, a distribution of the fiber length and fiber width over the number of fibers, from which the number-averaged length and width as well as the proportion of fine fibers can be determined.

The number-averaged length of the fibers in the filter paper thus obtained should be greater than 1 mm and less than 5 mm, and preferably greater than 2 mm and less than 4 mm.

Furthermore, the number-averaged width of the fibers in the filter paper thus obtained is between 10 μm and 50 μm, preferably between 20 μm and 40 μm, and highly particularly preferably between 25 μm and 35 μm.

The filter paper according to the invention contains fibers, wherein the fibers at least comprise pulp fibers. Pulp fibers are cellulose-based fibers of plant origin, for example long-fiber pulp fibers or short-fiber pulp fibers. In the context of the invention, fibers from plastics, fibers from regenerated cellulose and in particular cellulose acetate fibers are not pulp fibers.

The pulp fibers can be bleached or unbleached or can be a mixture of bleached and unbleached pulp fibers. Preferably, the pulp fibers are bleached, because the filter paper is then white and this color is expected by the smoker. The at least partial use of unbleached pulp fibers leads to a filter paper with a light brown to dark brown color and is less preferred.

To achieve sufficient strength and air permeability of the filter paper and a corresponding filtration efficiency of a filter manufactured therefrom, a high proportion of the fibers has to be formed from long-fiber pulp fibers. The proportion of long-fiber pulp fibers should be at least 80% by weight, preferably at least 90% by weight and particularly preferably at least 95% by weight, and highly particularly preferably 100% by weight of the filter paper with respect to the weight of the filter paper.

The indication that 100% by weight of the filter paper is formed by long-fiber pulp should be understood to mean that the filter paper essentially exclusively contains long-fiber pulp fibers. This indication should thus include filter papers, which contain contaminants by arbitrary other substances and materials such as, for example, other fibers, short-fiber pulp fibers, filler materials, pigments, additives or processing aids, as they can occur in paper production according to the state of the art.

The long-fiber pulp can be sourced from coniferous wood, in particular spruce or pine, but also from other plants such as hemp, flax, sisal, abacá, cotton, ramie, jute, kenaf, gampi, kozu or matsumata. The skilled person understands that the term "long-fiber pulp" refers to the natural length of the fibers and not to the actual length in the refined state in the paper.

It is necessary for the filter paper according to the invention to contain a certain proportion of fine fibers. The fine fibers include all fibers with a length of less than 0.2 mm. The proportion of fine fibers in the filter paper according to the invention is between 2% and 10% with respect to the number of fibers in the filter paper, preferably between 3% and 9% and particularly preferably between 4% and 8%, each with respect to the number of fibers in the filter paper.

It is also necessary for the filter paper according to the invention to have an air permeability within a defined interval, because the filtration efficiency of paper filters from this filter paper is adjusted in this manner. The air permeability of the filter paper according to the invention, measured in accordance with ISO 2965:2009 with a measuring head with an opening of 10 mm×20 mm, is between 500 $cm \cdot min^{-1} \cdot kPa^{-1}$ and 15000 $cm \cdot min^{-1} \cdot kPa^{-1}$ and preferably between 100 $cm \cdot min^{-1} \cdot kPa^{-1}$ and 9000 $cm \cdot min^{-1} \cdot kPa^{-1}$.

It is within the scope of the invention for the filter paper to further comprise pulp fibers such as short-fiber pulp fibers, or other fibers such as fibers from regenerated cellulose, such as, for example, viscose fibers, modal fibers, lyocell fibers, fibers from cellulose esters such as cellulose acetate or from plastics such as, for example, polyvinyl alcohol, polyethylene, polyester or polypropylene, or also fibers from polylactides. However, these fibers reduce the mechanical strength and the total proportion of such fibers should thus not be more than 10% by weight, preferably not more than 5% by weight and particularly preferably not more than 2% of the weight of the filter paper. In particular, viscose fibers, modal fibers, lyocell fibers, fibers from cellulose acetate, polyvinyl alcohol, polyethylene, polyester or polypropylene reduce the biodegradability and increase the price of the filter paper and create problems for manufacture of the filter paper due to their low density, so that in a preferred embodiment the filter paper does not contain such fibers.

Short-fiber pulp fibers can be sourced from deciduous wood, in particular birch, beech or eucalyptus, but also from other plants such as esparto grass.

The filter paper can contain filler materials, for example, in order to influence the whiteness, color or opacity of the filter paper. In particular, if the filter from the filter paper according to the invention extends right up to the mouth end in the cigarette, so that the smoker can see it, the optical properties of the filter paper can be of importance. However, the filler materials reduce the strength of the filter paper and can influence the porous structure in an undesirable way. The proportion of the filler materials should thus not be more than 10% by weight, preferably not more than 5% by weight and particularly preferably not more than 2% of the weight of the filter paper. In a particularly preferred embodiment, the filter paper is free from filler materials.

Filler materials can be mineral filler materials, in particular carbonates, sulfates, silicates or oxides, in particular, for example, calcium carbonate, magnesium oxide, magnesium hydroxide, magnesium carbonate, titanium dioxide, talcum, kaolin or aluminum hydroxide, as well as mixtures thereof.

The particle shape, particle size distribution and crystal structure of the filler materials can vary over a wide range and the skilled person will select these parameters according to the state of the art and the purpose which the skilled person would like to achieve.

The filter paper according to the invention can contain pigments or colorants to provide the filter paper with a defined color. Iron oxides, which are typically yellow, red or black and can be used alone or in mixtures, constitute exemplary pigments. Iron oxides or other pigments or colorants can change their color permanently or temporarily upon heating, so that these materials can also be added, if special optical effects during or after smoking are to be achieved.

The filter paper according to the invention can contain further additives to influence certain properties of the filter paper. These include, for example, sizing agents, such as, for example, alkyl ketene dimer (AKD), alkenyl succinic anhydride (ASA), fatty acids, fatty alcohols or other hydrophobic substances, to provide the filter paper with water-repellent properties, or starch to increase the strength of the filter paper, or wet strength agents.

Of particular interest can be the addition of additives which selectively influence certain substances in the smoke of a cigarette. Of particular importance in this regard are 44 substances, which are known as "Hoffmann Analytes". Specifically in this regards, the filter paper can contain substances to influence the carbon monoxide content such as, for example, catalysts; zinc oxide or other metal oxides; nitrates of the transition metals or of copper, iron or silver; or platinum. To influence, and in particular to reduce hydrogen cyanide (HCN), zinc oxide or sodium glycinate can be used. To influence formaldehyde, ascorbic acid, tartaric acid, sodium carbonate or polyethylene imine can be used. Similarly, additions of activated carbon, polyethylene glycol, triacetin or tri-ethyl citrate are possible. The sum of pigments, colorants and additives and all other substances that the skilled person can add to the filter paper to achieve certain effects should be not more than 10% by weight, preferably not more than 5% by weight and particularly preferably not more than 2% of the weight of the filter paper. In a particularly preferred embodiment the filter paper is at least free from pigments and colorants.

Generally, when specifying the components of the filter paper, toxicological aspects and legal requirements also have to be taken into account.

The mechanical properties of the filter paper are important for manufacturing a filter from the filter paper according to the invention. The mechanical properties of the filter paper differ in the machine direction, that is the direction in which the filter paper passes through the paper machine, and in the cross direction, that is the direction orthogonal to the direction of travel in the paper machine.

The tensile strength of the filter paper in the machine direction should be at least 7 N/15 mm, preferably at least 8 N/15 mm and particularly preferably at least 9 N/15 mm. A high tensile strength is not disadvantageous. However, because production of a filter paper with a high tensile strength corresponds to a high energy consumption when refining the fibers, the tensile strength will not be increased unnecessarily. The tensile strength in the machine direction should thus be at most 50 N/15 mm, preferably at most 45 N/15 mm and particularly preferably at most 40 N/15 mm.

The filter paper will be exposed to comparatively lower loads in the cross direction during filter production, so that the tensile strength in the cross direction is preferably at least 4 N/15 mm and particularly preferably at least 5 N/15 mm and preferably at most 9 N/15 mm and particularly preferably at most 8 N/15 mm.

Of equal importance to the tensile strength is the elongation at break, because this describes how well the filter paper can compensate for speed differences while passing through the machine during filter production. The elongation at break in the machine direction is thus preferably at least 1% and particularly preferably at least 1.2% and preferably at most 2% and particularly preferably at most 1.8%.

In addition, the elongation at break in the cross direction plays a role, because stretching of the filter paper in the cross direction can also occur during filter making. Thus, the elongation at break in the cross direction should preferably be at least 4% and particularly preferably at least 4.5%, and preferably at most 6% and particularly preferably at most 5.5%.

The filter paper can be crimped in the machine direction or in cross-direction. In this case, its elongation at break in the direction or the directions in which the filter paper is crimped is at most 25%, preferably at most 15% and particularly preferably at most 10%.

The tensile strength in the machine direction and in the cross direction can be measured in accordance with ISO 1924-2:2008.

The basis weight of the filter paper can, for example, be of importance for the hardness of a filter manufactured from this filter paper. The basis weight is thus preferably from 10 to 80 $g \cdot m^{-2}$, particularly preferably from 20 to 60 $g \cdot m^{-2}$, highly particularly preferably from 30 to 40 $g \cdot m^{-2}$. The basis weight of a filter paper can be measured in accordance with ISO 536:2012.

As well as the basis weight, the thickness of the filter paper can be of importance for the hardness of the filter manufactured from this filter paper. The thickness is thus preferably from 60 μm to 160 μm and particularly preferably from 80 μm to 120 μm. The thickness of a filter paper can be determined for a single layer of the filter paper in accordance with ISO 534:2011.

The filter paper according to the invention can be manufactured by the following process according to the invention.

The first step (A) comprises providing an aqueous suspension of unrefined fiber material in a storage tank. This process step can be carried out in accordance with processes known in the state of the art.

The unrefined fiber material comprises pulp fibers, in particular long-fiber pulp fibers. The pulp fibers can be bleached or unbleached or a mixture of bleached or unbleached pulp fibers. Preferably, though, the unrefined pulp fibers are bleached, because then the filter paper is white and this color is expected by the smoker.

The proportion of unrefined long-fiber pulp fibers with respect to the weight of the unrefined fiber material is at least 80% by weight, preferably at least 90% by weight and particularly preferably at least 95% by weight and highly particularly preferably 100% by weight.

The indication that 100% by weight is formed by unrefined long-fiber pulp fibers should be understood to mean that the unrefined fiber material essentially exclusively contains unrefined long-fiber pulp fibers. This indication should thus also include unrefined fiber material which contains contaminations by any other substances and materials such as, for example, other fibers, short-fiber pulp fibers, filler material, pigments, additives or processing aids, as they can occur in paper making according to the state of the art.

The long-fiber pulp is sourced from coniferous wood such as, for example, spruce or pine, or from flax, hemp, sisal, abacá, cotton, ramie, jute, kenaf, gampi, kozu or matsumata.

The unrefined fiber material can also comprise further pulp fibers such as short-fiber pulp fibers, or other fibers such as fibers from regenerated cellulose such as, for example, viscose fibers, modal fibers or Lyocell fibers, fibers from cellulose esters such as cellulose acetate or of plastics such as, for example, polyvinyl alcohol, polyethylene, polyester or polypropylene or fibers from polylactides. The total proportion of such fibers should not be more than 10% by weight, preferably not more than 5% by weight and particularly preferably not more than 2% of the weight of the unrefined fiber material.

Short-fiber pulp fibers can be sourced from deciduous wood, in particular birch, beech or eucalyptus, but also from other plants such as esparto grass.

In a further, optional process step, other materials such as filler materials, additives, processing aids, pigments or colorants can be added to the aqueous suspension of unrefined fiber material.

Regarding the type and amount of filler materials, additives, processing aids, pigments and colorants, the aforementioned limitations apply.

In a further processing step (B), at least a part of the aqueous suspension of mainly or exclusively unrefined long-fiber pulp fibers and further optional components provided in step (A) is supplied to a refiner and is refined there. The part of the unrefined fiber material that is refined in the refiner is at least 40% by weight, preferably at least 50% by weight and particularly preferably at least 60% by weight, each with respect to the total amount of the original unrefined fiber material. If a part of the suspension of the unrefined fiber material is not refined, it can be added again in a later process step. However, it is also possible for the entire suspension provided in step (A) to have been refined, and at a later point in time a different suspension, which contains unrefined long-fiber pulp fibers or other fiber materials, is added.

For the process according to the invention, it is essential for the refiner to be a Papillon refiner. The inventors have found that in particular, such a Papillon refiner can refine the fiber material such that the desired special combination of air permeability, fine fiber content and strength properties of the filter paper can be achieved.

In contrast to common double-disc refiners or cone refiners, refining in a Papillon refiner takes place in a cylindrical geometry. In this manner, the fiber material is treated in a particularly gentle manner and less energy is needed for the refining. The inventors believe that the particular distribution of fiber lengths and fiber widths and in particular the proportion of fine fibers can be achieved with such refiners, while this is not possible with commonly used double-disc refiners or cone refiners.

Papillon refiners are offered by various machine manufacturers, for example by Andritz with the model names CS380, CS450, CC380 and CC450. The following indications apply as an example to a Papillon refiner CS380 from Andritz and can easily be transferred to other refiners using the knowledge of the skilled person or by means of experiments.

The settings of the Papillon refiner need to be adapted to the type and amount of the unrefined fiber material, the dimensions of the refiner and the refiner filling. A suitable stock consistency, that is, a proportion by mass of the dry fiber material in the suspension used for refining, is between 1% by weight and 5% by weight. The flow rate can be between 300 $l \cdot min^{-1}$ and 700 $l \cdot min^{-1}$. The specific refiner edge load can be between 0.3 $J \cdot m^{-1}$ and 1.0 $J \cdot m^{-1}$.

Preferably, the fiber material is refined by using an energy of 30 $W \cdot h \cdot kg^{-1}$ to 100 $W \cdot h \cdot kg^{-1}$, with respect to the mass of the dry, unrefined fiber material. To refine the fiber material in a Papillon refiner, the revolutions per minute and the power need to be defined. In the process according to the invention the revolutions are between 500 $min^{-1}$ and 2000 $min^{-1}$ and preferably between 600 $min^{-1}$ and 1600 $min^{-1}$. In preferred embodiments, the power supplied to the Papillon refiner is between 50 kW and 200 kW, preferably between 60 kW and 150 kW.

The air permeability of the filter paper can be adjusted by selection of the revolutions per minute and the power. In general, a high number of revolutions per minute or low power lead to higher air permeability. Vice versa, a low number of revolutions per minute or high power lead to lower air permeability.

That part of the suspension of unrefined fiber material that was separated before and was not refined is then added to the suspension of the refined fiber material.

In a further, optional process step, other materials such as filler materials, additives, processing aids, pigments or colorants can be added to the aqueous suspension of the refined fiber material. The aforementioned limitations apply as regards the type and amount of filler materials, additives, processing aids, pigments and colorants.

In addition, adding refined fiber material from one or more different refiners is possible in this process step, wherein, however, when refined long-fiber pulp fibers are not involved, the limits mentioned above in the first process step (A) need to be observed.

In particular, fine fibers, i.e. fibers with a length of at most 0.2 mm, can be added to the aqueous suspension in this step, to adjust the filtration efficiency. The proportion of fine fibers in the finished aqueous suspension is in total between 2% and 10% with respect to the number of fibers in the aqueous suspension, preferably between 3% and 9% and particularly preferably between 4% and 8%, each with respect to the number of fibers in the aqueous suspension. The term "finished suspension" refers to the suspension in the state in which it is supplied to a paper machine in a step (C) described further below, that is, after all additions of further unrefined long-fiber pulp, fiber material or fine fibers have taken place.

The length and width of the fibers is significant in the finished aqueous suspension. The mean length of the fibers in the finished aqueous fiber suspension should preferably be more than 1 mm and less than 5 mm and particularly preferably more than 2 mm and less than 4 mm.

The mean width of the fibers in the finished aqueous fiber suspension is preferably between 10 μm and 50 μm, particularly preferably between 20 μm and 40 μm, and highly particularly preferably between 25 μm and 35 μm.

In a subsequent process step (C), the finished aqueous suspension is supplied to a paper machine and there a filter paper is manufactured according to a process known in the state of the art. Preferably, the paper machine is an inclined-wire machine, because papers with a particularly high air permeability and a filtration efficiency which is very suitable for the filtration of cigarette smoke can be manufactured on these machines. Less preferred alternatives are Fourdrinier machines or cylinder machines.

On a paper machine that is suitable for the process, the suspension is first stored in a head box and then pumped to the wire, so that a large part of the water flows through the wire, while the fiber material and other components for the most part remain on the wire and form a fiber web. Afterwards, the fiber web runs through a press section, in which the fiber web is further de-watered by mechanical pressure, for example against a felt, and further through a drying section, in which the fiber web is dried by heat, micro-wave radiation or infra-red radiation, preferably by contacting steam-heated drying cylinders and highly particularly preferably by hot air, in particular by impingement drying or through-drying, until it has a moisture content of 3% by weight to 10% by weight with respect to the mass of the filter paper. Drying by impingement drying or through-drying is particularly preferred, because it provides the filter paper with a high porosity and a high thickness. Finally, the filter paper is wound up and is optionally cut into narrow reels with a width of at least 100 mm and at most 400 mm, which can then be used to manufacture cigarette filters.

To manufacture a filter rod from the filter paper, a filter paper web with a width of at least 100 mm and at most 400 mm, for example about 300 mm, is commonly embossed or crimped, occasionally at elevated temperature or humidity. Crimping can be carried out in the machine direction, in the cross direction or in both directions; in addition, crimping can be diagonal, in any direction, or in the form of patterns. As with conventional cellulose acetate filters, the filter paper is then formed into a continuous rod, which is wrapped with a filter wrapping paper. Rods are subsequently cut from this endless rod filter.

Any filter wrapping paper known in the state of the art can be used as a filter wrapping paper, in particular a low-porosity filter wrapping paper or a filter wrapping paper with an air permeability, measured in accordance with ISO 2965: 2009, between 1000 $cm \cdot min^{-1} \cdot kPa^{-1}$ and 30000 $cm \cdot min^{-1} \cdot kPa^{-1}$.

The invention further relates to a paper filter comprising the filter paper according to the invention.

In this regard, the filter paper according to the invention can be a filter rod with a length of 60 mm to 200 mm, preferably with a length of 80 mm to 180 mm. The length of the filter rod is therefore an integer multiple, preferably four or six times, of the length of the filter plug, which then serves as the filter on the cigarette.

The filter paper according to the invention can thus also be a filter plug with a length of 10 mm to 50 mm, preferably with a length of 15 mm to 30 mm.

The filter paper according to the invention can also be a segment of a cigarette filter. This can be the case, for example, if the cigarette filter consists of a segment of cellulose acetate and a segment with filter paper or also, if, for example, the cigarette filter paper is provided with a cavity with activated carbon particles, which is delimited by two segments, which can contain filter paper. The paper filter according to the invention can thus also have a length from 3 mm to 10 mm, preferably from 4 mm to 8 mm.

The paper filter, that is, the filter rod, filter plug or the paper filter segment, has a diameter between 3 mm and 10 mm, preferably between 4 mm and 9 mm and particularly preferably between 7 mm and 9 mm. The diameter depends on the diameter of the cigarette which should contain the paper filter. To measure the diameter of a paper filter, CORESTA Guide No. 10 can be considered.

The draw resistance of a paper filter essentially depends on the diameter, the filter material and the length of the paper filter and can be measured in accordance with ISO 6565: 2011 at a volumetric flow of 17.5 $cm^3 \cdot s^{-1}$. The draw resistance of a paper filter is given in Pa and, to a very good approximation, is proportional to the length of the paper filter, as long as the paper filter is approximately homogeneous over its length. Therefore, a specific draw resistance by length can be expressed as a pressure difference per mm length of the paper filter, if the value is independent of the specific length of the paper filter. The paper filter according to the invention has a specific draw resistance by length of between 10 $Pa \cdot mm^{-1}$ and 40 $Pa \cdot mm^{-1}$, preferably between 15 $Pa \cdot mm^{-1}$ and 35 $Pa \cdot mm^{-1}$.

An essential feature of a paper filter is its filtration efficiency for the particulate phase of the cigarette smoke. More precisely, for the particulate phase, the nicotine-free dry particulate matter (NFDPM), which is colloquially called "tar" is considered; its content in the smoke from a cigarette is occasionally given on the package in mg per cigarette. The filtration efficiency for NFDPM describes the mass ratio of the particulate phase of the smoke retained in the filter with respect to the total particulate phase of the smoke flowing into the filter. The filtration efficiency is expressed as a %. The filter comprising the filter paper according to the invention has a filtration efficiency for NFDPM of between 20% and 80%, preferably between 30% and 70%. The filtration efficiency of the filter is influenced by the diameter, length and draw resistance of the paper filter in the manner known in the state of the art.

The filtration efficiency of a filter is determined by first smoking a sufficient number of cigarettes, for example 20 items, on a smoking machine in accordance with ISO 3308:2012 and determining the NFDPM content in mg per cigarette, designated by X, in accordance with ISO 4387: 2000. In a further step, the filter of each smoked cigarette is separated and the amount of NFPDM contained in the filter in mg per cigarette, designated by Y, is analyzed. The filtration efficiency F of the filter is then the ratio $F=Y \cdot (X+Y)^{-1}$ and is expressed as a %.

In the case in which the filter consists of several segments, for example n segments with i=1, 2, . . . n, the amount of NFDPM contained in each filter segment can be determined and is designated as $Y_i$ in mg per cigarette. The numbering of the filter segments should in this regard be in ascending order in the flow direction of the smoke during normal use of the cigarette. The segment i=1 thus adjoins the tobacco rod of the cigarette, while the segment i=n is located at the mouth end. The filtration efficiency $F_k$ of segment k can then be calculated by the equation $$F_k = \frac{Y_k}{X + \sum_{i=k}^{n} Y_i}$$

i.e. by the ratio of the amount of NFDPM retained in the filter segment k to the amount of NFDPM flowing into the filter segment k, and is expressed as a %.

The invention also relates to a filter cigarette comprising a paper filter. The paper filter can be the sole filter on the filter cigarette, or can preferably be a segment in a segmented cigarette filter. A filter cigarette in which the filter segment located next to the mouth end is formed by cellulose acetate and at least one segment located closer to the tobacco rod contains filter paper according to the invention is particularly preferred, because then the optical appearance of the mouth end corresponds to that of a filter cigarette with a cellulose acetate filter and thereby fulfills the smoker's expectations.

Manufacture of a filter cigarette comprising a paper filter according to the invention can be carried out according to processes known in the state of the art.

BRIEF DESCRIPTION OF THE FIGURES

FIG. 1 shows a table 1, which contains the fiber properties of 16 different filter papers, the fiber material of which has been refined with different settings of a Papillon refiner.

FIG. 2 shows a table 2, which contains the basis weight, the thickness, the air permeability, the tensile strength and the elongation of the 16 papers of the table from FIG. 1.

FIG. 3 shows a table 3, which contains the filtration efficiency, the draw resistance and the specific draw resistance of the 16 papers of the table from FIG. 1.

DESCRIPTION OF THE PREFERRED EMBODIMENTS

Figure 4:
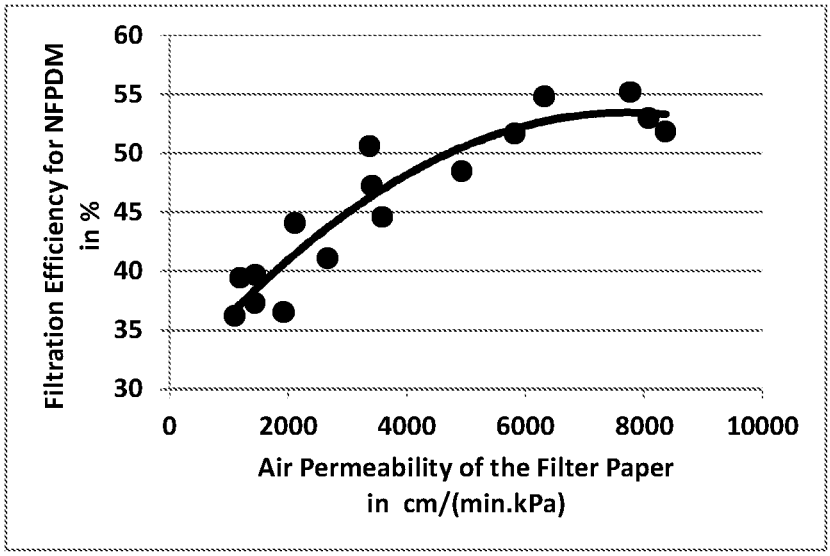
FIG. 4 shows the relationship between the air permeability of the filter paper according to the invention and the filtration efficiency for NFDPM of paper filters manufactured from the filter papers.

The following examples are intended to demonstrate the invention and its advantages.

As the fiber material, unrefined long-fiber pulp fibers which had only been bleached were refined in a Papillon refiner at different revolutionary speeds between 600 $min^{-1}$ and 1200 $min^{-1}$ and power settings between about 60 kW and about 140 kW. 16 different combinations of power settings and revolutionary speeds in total were selected. The specific values are provided in table 1 ("Settings of the Papillon Refiner"), which is shown in FIG. 1. Unrefined long-fiber pulp fibers were added to the refined long-fiber pulp fibers, so that the entire suspension of long-fiber pulp fibers contained about 60% by weight refined and about 40% by weight unrefined long-fiber pulp fibers.

Furthermore, the properties of the fibers in the suspension were determined following ISO 16065 using a L&W Fiber Tester Plus—code 912 Plus, wherein the fine fibers, that is fibers with a length of less than 0.2 mm, were also taken into consideration.

The mean fiber length, the mean fiber width and the proportion of fine fibers as a % with respect to the number of fibers are provided in the corresponding columns of table 1 from FIG. 1. The mean fiber length for the exemplary filter papers according to the invention is between about 2 mm and 2.5 mm, the mean fiber width is between 30.5 μm and 31.5 μm and the proportion of fine fibers is between 5% and 8% with respect to the number of fibers in the fiber material.

The inventors believe that such constant fiber properties can only be achieved with a Papillon refiner despite the variable air permeability of the filter paper, and that these fiber properties essentially contribute to the filtration efficiency of the filters manufactured from these filter papers.

16 different filter papers were manufactured on an inclined-wire machine from these 16 differently refined long-fiber pulps. The filter papers are numbered from 1 to 16 according to the column "No." in tables 1 to 3 shown in FIGS. 1 to 3, wherein in all tables, each number designates the same filter paper and the filter manufactured therefrom, respectively.

The basis weight in accordance with ISO 536:2012, the thickness in accordance with ISO 534:2011 and the air permeability in accordance with ISO 2965:2009 were determined for each filter paper and are shown in the corresponding columns in table 2 (FIG. 2). The basis weight is between 34.9 $g \cdot m^{-2}$ and 36.6 $g \cdot m^{-2}$ and thus is in a very narrow range; also, the thickness only varies between 83 μm and 101 μm. The air permeability of the filter paper on the other hand varies as a function of the degree of refining of the fiber material and is between 1099 $cm \cdot min^{-1} \cdot kPa^{-1}$ and 8364 $cm \cdot min^{-1} \cdot kPa^{-1}$.

In addition, the tensile strength and the elongation at break were determined in accordance with ISO 1924-2:2008 for the non-crimped filter paper respectively in the machine direction (MD) and in the cross direction (CD). Furthermore, these values are provided in the corresponding columns of table 2 (FIG. 2). The values for the tensile strength exceed the minimum technically required to manufacture filters from the filter papers. Similarly, the elongation at break is in a range which is well suited to further processing of the filter paper.

Paper filter rods with a circumference of 24.35 mm and a length of 132 mm were manufactured on a laboratory filter maker from a 240 mm wide reel of each of the 16 filter papers by using an non-porous filter wrapping paper.

The draw resistance of each paper filter rod was determined in accordance with ISO 6565:2011 and is provided in the corresponding columns of table 3 (FIG. 3) calculated for a length of 22 mm and for a specific draw resistance.

Each paper filter rod was divided into six paper filter plugs of equal length of 22 mm and cigarettes were manufactured therefrom with a length of 83 mm, a circumference of 24.5 mm, a length of the tobacco rod of 61 mm and a tobacco weight of 600 mg. The tobacco was formed into a tobacco rod with a conventional cigarette paper with an air permeability of 50 $cm \cdot min^{-1} \cdot kPa^{-1}$. The paper filters were wrapped with a 27 mm long tipping paper, so that the tipping paper overlaps the tobacco rod by 5 mm and thereby connects the paper filter to the tobacco rod.

The tobacco blend and all geometrical data of the cigarettes were identical, so that they only differed with respect to the paper filter. With these cigarettes, the filtration efficiency was determined according to the procedure described above.

The filtration efficiency for nicotine-free dry particulate matter (NFDPM) is provided for each of the 16 filter plugs (22 mm) in table 3 (FIG. 3). The filtration efficiency for NFPDM was between 36.2% and 55.2%. By modification of the length of the filter plug or by using a different reel width to manufacture the paper filter rod, filtration efficiencies below or above this interval can be achieved without any problems, so that the filter paper according to the invention can cover an interval of filtration efficiencies that is normal for filters from cellulose acetate.

FIG. 4 shows the relationship between the filtration efficiency for NFDPM of the paper filter according to the invention and the air permeability of the filter paper. It can be seen that the air permeability is an essential parameter for adjusting the filtration efficiency over a wide range, because all other parameters, such as, for example, basis weight, thickness or fiber properties, were kept almost constant.

Figure 5:
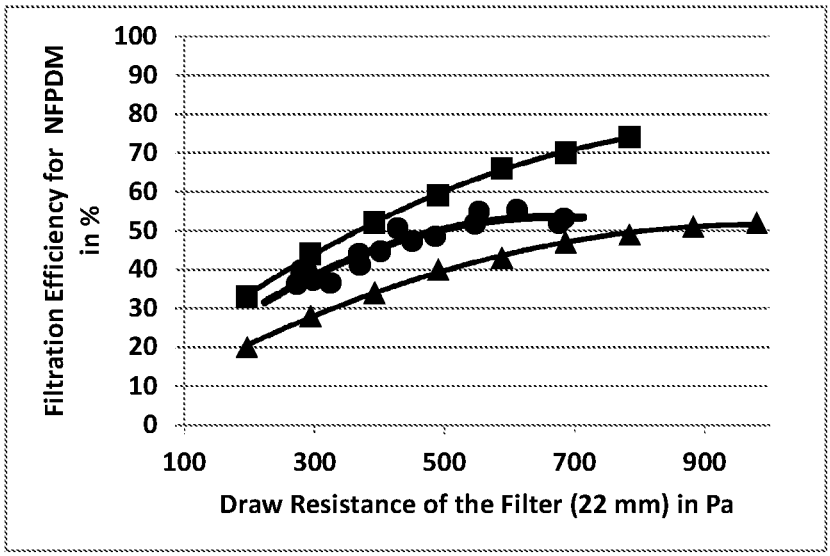
FIG. 5 shows the relationship between the draw resistance of a filter and the filtration efficiency for NFDPM for the paper filters according to the invention (circles), conventional paper filters (squares) and conventional filters from cellulose acetate (triangles).

The essential advantage of the invention can be demonstrated in FIG. 5. The figure shows the relationship between the draw resistance of a filter and the filtration efficiency for NFDPM for the paper filters according to the invention (circles), conventional paper filters (squares) and conventional filters from cellulose acetate (triangles). All filters had a length of 22 mm.

One of the disadvantages of conventional paper filters can clearly be seen. For example, if a filtration efficiency for NFDPM of 45% is desired, then a conventional paper filter has a draw resistance of about 300 Pa, while a conventional cellulose acetate filter has a draw resistance of about 600 Pa. The draw resistance of an unventilated filter cigarette is essentially determined by the draw resistance of the filter and of the tobacco rod. For a king-size cigarette with a circumference of 24 mm to 25 mm, the smoker expects a draw resistance of about 1000 Pa. Thus, if the conventional cellulose acetate filter with a draw resistance of 600 Pa is exchanged for a conventional paper filter with 300 Pa in an existing cigarette design, the draw resistance of the filter cigarette drops to 700 Pa, that is by 30%. This difference is clearly noticeable for the smoker and is not wanted.

With the filter paper according to the invention, however, at a filtration efficiency for NFDPM of 45%, a paper filter with a draw resistance of about 400 Pa can be manufactured, see example 6, so that the draw resistance of the cigarettes drops to 800 Pa. Thus, in comparison to a conventional filter paper, much less effort is required to adjust the cigarette design to the modified draw resistance.

Similarly, with a conventional filter formed from cellulose acetate at a draw resistance of 700 Pa, a filtration efficiency for NFDPM slightly below 50% can be achieved, while at this draw resistance a conventional paper filter has a filtration efficiency of 70%. With the filter paper according to the invention, for example that of example 3, a paper filter can be manufactured which has a filtration efficiency of slightly above 50% at a similar draw resistance, and is thus closer to a filter from cellulose acetate than a conventional paper filter. This means that the paper filter according to the invention also offers advantages over a conventional paper filter, when the draw resistance of the filter is to be kept constant.

Overall, FIG. 5 shows that with respect to filtration efficiency and draw resistance the paper filters according to the invention are always between conventional paper filters and conventional cellulose acetate filters and additionally at higher draw resistances, the difference between the paper filters according to the invention and the filters from cellulose acetate becomes smaller.

With the filter papers and the paper filters according to the invention, the advantages of paper filters can be utilized better and the change from cellulose acetate filters to the paper filters according to the invention requires fewer adjustments of the cigarette design than for conventional paper filters.

The invention claimed is:

1. Filter paper for manufacturing filters for smoking articles, with the following properties:

the filter paper comprises fibers comprising pulp fibers, at least 80% by weight of the filter paper is formed by long-fiber pulp fibers, of the fibers, a proportion with respect to the number of the fibers of between 2% and 10% has a length of less than 0.2 mm, the air permeability of the filter paper, measured in accordance with ISO 2965:2009, is between 500 $cm \cdot min^{-1} \cdot kPa^{-1}$ and 15000 $cm \cdot min^{-1} \cdot kPa^{-1}$, the number-averaged length of the fibers in the filter paper is greater than 1 mm and less than 5 mm, and the number-averaged width of the fibers in the filter paper is between 10 μm and 50 μm, wherein said filter paper is crimped in the machine direction or in the cross direction, and wherein the elongation at break in the direction or the directions in which the filter paper is crimped is at most 25%.

2. Filter paper according to claim 1, in which the pulp fibers are bleached, unbleached or form a mixture of bleached and unbleached pulp fibers.

3. Filter paper according to claim 1, in which the long-fiber pulp is sourced from coniferous wood, or from hemp, flax, sisal, aback cotton, ramie, jute, kenaf, gampie, kozu or matsumata.

4. Filter paper according to claim 1, which comprises at most 5% by weight of short-fiber pulp fibers with respect to the mass of the filter paper, wherein said short-fiber pulp fibers are sourced from birch, beech or eucalyptus wood, or from esparto grass.

5. Filter paper according to claim 1, which comprises at most 5% by weight filler materials with respect to the mass of the filter paper, wherein said filler materials are selected from the group consisting of calcium carbonate, magnesium oxide, magnesium hydroxide, magnesium carbonate, titanium dioxide, talcum, kaolin or aluminum hydroxide, and mixtures thereof.

6. Filter paper according to claim 1, which contains pigments or colorants.

7. Filter paper according to claim 6, wherein the pigments or colorants are iron oxides or a mixture of iron oxides.

8. Filter paper according to claim 1, which contains alkyl ketene dimer (AKD), alkenyl succinic anhydride (ASA), a hydrophobic substance or one or more fatty acids or one or more fatty alcohols, starch or wet strength agents.

9. Filter paper according to claim 1, wherein the tensile strength in the machine direction is at least 8 N/15 mm and/or at most 45 N/15 mm.

10. Filter paper according to claim 1, wherein the tensile strength in the cross direction is at least 4 N/15 mm and/or at most 9 N/15 mm.

11. Filter paper according to claim 1, wherein the elongation at break in the machine direction is at least 1% and/or at most 2%.

12. Filter paper according to claim 1, wherein the elongation at break in the cross direction is at least 5% and/or at most 6%.

13. Filter paper according to claim 1, wherein the basis weight is between 20 and 60 $g \cdot m^{-2}$.

14. Filter paper according to claim 1, wherein the thickness is between 60 μm and 160 μm.

15. Filter paper according to claim 1, wherein at least 95% by weight of the filter paper is formed by long-fiber pulp fibers.

16. Filter paper according to claim 1, wherein of the fibers, a proportion with respect to the number of the fibers of between 4% and 8% has a length of less than 0.2 mm.

17. Filter paper according to claim 1, wherein the air permeability of the filter paper, measured in accordance with ISO 2965:2009, is between 1000 $cm \cdot min^{-1} \cdot kPa^{-1}$ and 9000 $cm \cdot min^{-1} \cdot kPa^{-1}$.

18. Filter paper according to claim 1, wherein the number-averaged length of the fibers in the filter paper is greater than 2 mm and less than 4 mm.

19. Filter paper according to claim 1, wherein the number-averaged width of the fibers in the filter paper is between 25 μm and 35 μm.

20. Process for manufacturing a filter paper for the manufacture of filters for smoking articles, comprising the following steps:

(A) Providing an aqueous suspension of unrefined fiber material, wherein the unrefined fiber material comprises unrefined long-fiber pulp fibers and the proportion of unrefined long-fiber pulp fibers is at least 80% by weight of the unrefined fiber material and the aqueous suspension contains between 1% by weight and 5% by weight unrefined fiber material, (B) refining the fiber material in the aqueous suspension from step (A) or the fiber material from a separated part of the aqueous suspension from step (A) in a Papillon refiner with a refining energy between 30 $W \cdot h \cdot kg^{-1}$ and 100 $W \cdot h \cdot kg^{-1}$ with respect to the mass of the unrefined fiber material and a specific refining edge load of between 0.3 $J \cdot m^{-1}$ and 1.0 $J \cdot m^{-1}$, and (C) supplying the suspension from step (B) to a paper machine, and forming a filter paper in the paper machine, wherein the number-averaged length of the fibers in the suspension supplied in step (C) is greater than 1 mm and less than 5 mm, and wherein the number-averaged width of the fibers of the suspension supplied in step (C) is between 10 μm and 50 μm, and wherein said filter paper is crimped in the machine direction or in the cross direction, and wherein the elongation at break in the direction or the directions in which the filter paper is crimped is at most 25%.

21. Process according to claim 20, in which between step (B) and (C), a further suspension is added to the suspension which has undergone refining in step (B), and which contains unrefined long-fiber pulp fibers, so that in the mixture of both suspensions, at least 40% by weight of the long-fiber pulp fibers are refined, wherein said further suspension is formed by the separated part of the suspension provided in step (A).

22. Process according to claim 20, in which the step (B) for refining the fiber material is carried out and the suspension supplied in step (C) has a proportion of fibers with a length of less than 0.2 mm of between 2% and 10% with respect to the number of fibers.

23. Process according to claim 22, in which fibers with a length of at most 0.2 mm are added between steps (B) and (C).

24. Process according to claim 22, in which the suspension supplied in step (C) has a proportion of fibers with a length of less than 0.2 mm of between 4% and 8% with respect to the number of fibers.

25. Process according to claim 20, which further comprises a step (D) of crimping the filter paper in the machine direction and/or in the cross direction.

26. Process according to claim 20, in which the proportion of unrefined long-fiber pulp fibers in step (A) is at least 95% by weight of the unrefined fiber material.

27. Process according to claim 20, in which the paper machine of step (C) is an inclined-wire machine.

28. Process according to claim 20, in which the number-averaged length of the fibers in the suspension supplied in step (C) is greater than 2 mm and less than 4 mm.

29. Process according to claim 20, in which the number-averaged width of the fibers of the suspension supplied in step (C) is between 25 μm and 35 μm.

30. Process for manufacturing a filter paper according to claim 1, comprising the following steps:

(A) Providing an aqueous suspension of unrefined fiber material, wherein the unrefined fiber material comprises unrefined long-fiber pulp fibers and the proportion of unrefined long-fiber pulp fibers is at least 80% by weight of the unrefined fiber material and the aqueous suspension contains between 1% by weight and 5% by weight unrefined fiber material, (B) refining the fiber material in the aqueous suspension from step (A) or the fiber material from a separated part of the aqueous suspension from step (A) in a Papillon refiner with a refining energy between 30 $W \cdot h \cdot kg^{-1}$ and 100 $W \cdot h \cdot kg^{-1}$ with respect to the mass of the unrefined fiber material and a specific refining edge load of between 0.3 $J \cdot m^{-1}$ and 1.0 $J \cdot m^{-1}$, and (C) supplying the suspension from step (B) to a paper machine, and forming a filter paper in the paper machine, wherein the number-averaged length of the fibers in the suspension supplied in step (C) is greater than 1 mm and less than 5 mm, wherein the number-averaged width of the fibers of the suspension supplied in step (C) is between 10 μm and 50 μm, and wherein said filter paper is crimped in the machine direction or in the cross direction, and wherein the elongation at break in the direction or the directions in which the filter paper is crimped is at most 25%.

31. Cigarette filter which is manufactured at least in part from a filter paper with the following properties:

the filter paper comprises fibers comprising pulp fibers, at least 80% by weight of the filter paper is formed by long-fiber pulp fibers, of the fibers, a proportion with respect to the number of the fibers of between 2% and 10% has a length of less than 0.2 mm, the air permeability of the filter paper, measured in accordance with ISO 2965:2009, is between 500 $cm \cdot min^{-1} \cdot kPa^{-1}$ and 15000 $cm \cdot min^{-1} \cdot kPa^{-1}$, the number-averaged length of the fibers in the filter paper is greater than 1 mm and less than 5 mm, and the number-averaged width of the fibers in the filter paper is between 10 μm and 50 μm, wherein said filter paper from which said cigarette filter is manufactured at least in part is crimped in the machine direction or in the cross direction, and wherein the elongation at break in the direction or the directions in which the filter paper is crimped is at most 25%.

32. Cigarette filter according to claim 31, which is present in one of the following forms:

as filter rod with a length of 60 mm to 200 mm, from which filter plugs or filter plug segments can be manufactured, as filter plug with a length of 10 mm to 50 mm, or as filter plug segment with a length of 3 mm to 10 mm.

33. Filter cigarette comprising a tobacco rod and a cigarette filter, wherein the cigarette filter is formed by a filter plug according to claim 32 or contains a filter plug segment according to claim 32.

34. Filter cigarette according to claim 33, of which the cigarette filter has a filtration efficiency for NFDPM of 20% to 80%.

35. Filter cigarette according to claim 33, with a segmented cigarette filter, which comprises a filter plug segment according to claim 32 and a filter plug segment from cellulose acetate, wherein the filter plug segment from cellulose acetate is located at the mouth end of the cigarette.

36. Cigarette filter according to claim 31, with a diameter of 3 mm to 10 mm.

37. Cigarette filter according to claim 31, with a specific draw resistance of 10 $Pa \cdot mm^{-1}$ to 40 $Pa \cdot mm^{-}$.

* * * * *